United States Patent [19]

Zinke et al.

[11] Patent Number: 4,910,062

[45] Date of Patent: Mar. 20, 1990

[54] SHEET MATERIAL USED TO FORM PORTIONS OF FASTENERS

[75] Inventors: Bradley D. Zinke, North St. Paul; Bernard D. Campbell, Fairmont; Susan K. Nestegard, Woodbury, all of Minn.

[73] Assignee: Minnesota Mining and Manufacturing Company, Saint Paul, Minn.

[21] Appl. No.: 380,771

[22] Filed: Jul. 17, 1989

Related U.S. Application Data

[63] Continuation of Ser. No. 159,217, Feb. 23, 1988, abandoned.

[51] Int. Cl.[4] ..... B32B 3/02

[52] U.S. Cl. ..... 428/95; 156/72; 428/97; 428/100; 428/296; 428/373; 428/374; 428/913

[58] Field of Search ..... 428/95, 97, 100, 296, 428/373, 374, 913; 156/72

[56] References Cited

U.S. PATENT DOCUMENTS

| | | | |
|---|---|---|---|
| 2,594,521 | 4/1952 | Tingley | 28/73 |
| 4,024,003 | 5/1977 | Buhler | 156/148 |
| 4,668,552 | 5/1987 | Scott | 428/92 |
| 4,770,917 | 9/1988 | Tochacek | 428/95 |
| 4,795,668 | 1/1989 | Krueger | 428/373 |

FOREIGN PATENT DOCUMENTS

| | | |
|---|---|---|
| 3533535 | 4/1987 | Fed. Rep. of Germany . |
| 60-017140 | 1/1985 | Japan . |
| 60-059121 | 4/1985 | Japan . |
| 71-005262 | 2/1986 | Japan . |

*Primary Examiner*—Marion C. McCamish
*Attorney, Agent, or Firm*—Donald M. Sell; Walter N. Kirn; William L. Huebsch

[57] ABSTRACT

A method for making a sheet material adapted to be cut into smaller ravel resistant pieces to form portions of a fastener by intersecting (e.g., weaving or knitting) portions of base yarns to form a backing, with at least some of the base yarns being bonded yarns including a first portion formed of a polymeric structural material and a second portion formed of a thermoplastic binding material having a significantly lower melting temperature than the softening temperature of the structural material. Portions of pile yarns are entwined in the backing with the entwined portions of the pile yarns contacting at least one of the bonding yarns, while other portions of the pile yarn project from the backing to form loops or hooks. The backing is heated to soften the binding material so that it flows and, upon cooling, adheres to adjacent portions of the yarns, thereby anchoring the pile yarns in the backing.

25 Claims, 3 Drawing Sheets

SHEET MATERIAL USED TO FORM PORTIONS OF FASTENERS

This is a continuation of application Ser. No. 07/159,217 filed Feb. 23, 1988, now abandoned.

TECHNICAL FIELD

The present invention relates to sheet materials that can be cut into smaller pieces to form portions of fasteners, and methods for forming such sheet materials.

BACKGROUND ART

The art is replete with sheet materials that can be cut into smaller pieces to form portions of fasteners, and methods for making such sheet materials. U.S. Pat. Nos. 2,933,797; 3,009,235; 3,136,026; 3,154,837; 3,577,607; 3,673,301; 3,943,981; and 4,024,003 provide illustrative examples. Generally these patents describe sheet materials including backings formed by intersecting backing yarns (e.g., intersected by weaving or knitting) from one surface of which backings project portions of pile yarns that form either loops, hooks formed by cutting loops along one side, or projections that have enlarged heads at their distal ends which may be engaged with other such projecting portions on other pieces of such sheet materials to form fasteners.

With fasteners of the type described above, it is important to anchor portions of the pile yards entwined in the backing so that the fastener will function properly. Various anchoring means have been described or known in the prior art to provide such anchoring, including tight weaving of the base and pile yarns, coating or impregnating the backing with an adhesive-like binding material, or including a thermoplastic yarn in the backing that is subsequently heated to cause the yarn to both adhere to adjacent yarns to anchor them while retaining sufficient structural strength to maintain the integrity of the backing. Such prior art anchoring means have typically significantly increased the cost of the resulting sheet materials because of the added materials or added processing steps they require, or in the case of the thermoplastic yarn, required tight packing of the yarn in the backing and a difficult processing step to produce the uniform processing temperature required.

DISCLOSURE OF THE INVENTION

The present invention provides a sheet material generally of the type described above which is adapted to be cut into smaller ravel resistant pieces to form portions of fasteners, which sheet material includes anchoring means for anchoring pile yarns in a backing of the sheet material formed by intersecting backing yarns (e.g., by weaving or knitting) that is at least as effective as the prior art anchoring means described above, and can be applied by a simple processing step either on the same production line on which the yarns are intersected to form the sheet material or during a heat treatment process commonly used in making such sheet materials, thereby reducing the number of processing steps required to make the sheet material.

The method according to the present invention for forming a sheet material adapted to be cut into smaller pieces to form portions of fasteners comprises the steps of (1) intersecting portions of polymeric base yarns (e.g., by weaving or knitting) to form a backing having front and rear major surfaces, at least some of the base yarns being bonding yarns comprising a first portion formed of a polymeric structural material and a second portion formed of a thermoplastic binding material having a significantly lower melting temperature than the softening temperature of the structural material; (2) entwining portions of polymeric pile yarns into the backing while causing other portions of the pile yarns to project from the front surface of the backing, with each entwined portion of each of the pile yarns contacting at least one of the bonding yarns; and (3) heating the backing to melt the binding material so that it flows and adheres to adjacent portions of the yarns.

Yarn as used in this application means any filament or combination of filaments that are guided by a single guide on a machine, such as a weaving or knitting machine, whether such filaments are twisted together, intertwined or laid side by side. The bonding yarns may be multifilament yarns with one or more of the filaments being of the structural material, and one or more of the filaments being of the thermoplastic binding material; may be monofilament yarns with a first continuous portion of the monofilament (e.g., its core or a first side portion) being of the structural material, and a second portion (e.g., a cylindrical portion around its core or a second side portion) being of the thermoplastic binding material; or may be coated or sheathed multifilaments with the multifilaments being of the structural material and the coating or sheathing material being of the thermoplastic binding material. The binding material should form in the range of about 15 to 80 percent by weight and preferably in the range of about 30 to 65 percent by weight of the bonding yarn to both provide sufficient binding material to firmly adhere to the structural material and to the contacted portions of the other yarns, and to provide a sufficient amount of the structural material to maintain the structural integrity of the bonding yarn after the binding material has melted.

When the backing is woven (e.g., on looms of the Jacquard type) and the base yarns comprise generally parallel warp yarns and filling yarns extending transverse to the warp yarns, the bonding yarn can be used for some or all of the filling yarns, some or all of the warp yarns, or all of both. Alternatively, when the backing is knitted the bonding yarn can be used for some or all of the base yarns.

The melting temperature of the binding material in the bonding yarn is highly dependent on the combination of bonding and structural material being used, but generally should be in the range of about 70 to 205 Degrees Centigrade (preferably in the range of 105 to 170 degrees Centigrade) and should be at least 20 Centigrade degrees less than the softening temperature of the structural material in the bonding yarn and the softening temperature of the material used to form the pile yarn and another yarn used in the backing.

The backing can be heated to melt the binding material by passing the second side of the backing along a heated platen on the same production line on which the backing is formed, or by subsequently inserting the backing in an autoclave which heat sets the backing at a temperature in that range. Alternatively, the backing could be heated by many other means such as heat lamps hot air or microwave energy.

In the resultant sheet material the entwined portions of the pile yarns should each contact (e.g., intersect or lay along) at least one or more of the bonding yarns with the binding material adhered to the structural material and to the contacted portions of the yarns primarily to firmly anchor the pile yarns in the backing, but also to provide fray resistance for cut pieces of the sheet material used to form portions of fasteners.

The method as described above may be used to form sheet material having projecting loops by using either monofilament pile yarns to provide maximum loop strength for a given yarn diameter, or by using multifilament yarns that, compared to monofilament yarns, can greatly increase the number of loops formed for a given number of pile yarns. Alternatively sheet material having a plurality of projecting hooks may be made by using monofilament pile yarns of a heat settable polymer (e.g., nylon or polyester) to form loops and adding the further steps of heating the loops so that they will resiliently retain their shape, and cutting each loop along one side to form the hooks; or sheet material having projections with enlarged heads on their distal ends may be made by using monofilament pile yarns, weaving the pile yarns back and forth between two parallel backings, and severing the projecting portions of the pile yarns between the backings with a heated member (e.g., wire or knife) to form the headed projections (e.g., see U.S. Pat. Nos. 3,993,105 and 4,024,003), or by forming loops with the monofilament pile yarns, and heating the upper portions of the loops to melt their central portions and form from each loop two projections with enlarged heads on their distal ends. Such heads can be made mushroom or globular shaped by selecting the proper polymeric material for the pile yarns (e.g., oriented polypropylene or nylon respectively) as is well known in the art, or can be caused to have hook-like portions projecting from the heads along the pile yarns that connect them to the backing by using monofilament pile yarns of polypropylene with lobes around their peripheries as is taught in U.S. Pat. No. 4,454,183 incorporated herein by reference.

Portions cut from such sheet material can be used for portions of fasteners in any of the applications for which prior art fastener portions are used, including on flexible garments and particularly on disposable garments such as disposable diapers. The anchoring provided by use of bonding yarns during manufacture of the sheet material both simplifies the manufacturing process and affords the use of an open weave in the baking of the sheet material, resulting in reduced cost for the sheet material.

BRIEF DESCRIPTION OF THE DRAWING

The present invention will be further described with reference to the accompanying drawing wherein like reference numerals refer to like parts i the several views, and wherein.

DETAILED DESCRIPTION

Figure 1:
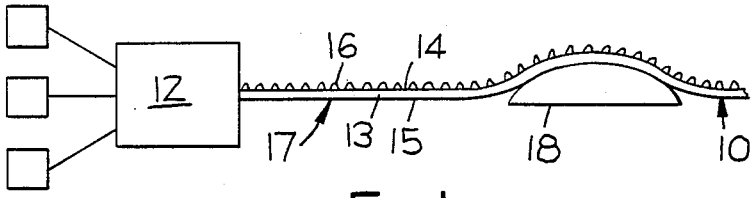
FIG. 1 is a schematic view of a method for forming sheet material according to the present invention.

Referring now to the drawing, there is schematically illustrated in FIG. 1 a method according to the present invention for making a sheet material 10 adapted to be cut into smaller ravel resistant pieces to form portions of a fastener. Generally, the method comprises the steps of (1) intersecting, for example by weaving or knitting through the use of a loom or knitting machine 12, portions of polymeric base yarns to form a backing 13 having front and rear major surfaces 14 and 15, with at least some of the base yarns being bonding yarns comprising a first portion formed of a polymeric structural material and a second portion formed of a thermoplastic binding material having a significantly lower melting temperature than the softening temperature of the structural material (i.e., in the range of about 70 to 205 Centigrade (preferably 105 to 70 degrees Centigrade), and at least 20 Centigrade degrees lower than the softening temperature of the structural material). The machine 12 also entwines or weaves portions of polymeric pile yarns 16 into the backing 13 while causing other portions of the pile yarns 16 to project in the form of loops from the front surface 14 of the backing 13, with the entwined portions of the pile yarns 16 contacting (by intersecting or laying along) at least one of the bonding yarns to provide an intermediate structure 17. The backing 13 of the intermediate structure 17 is then heated to melt the binding material in the bonding yarn so that it flows and upon subsequent cooling adheres to adjacent portions of the yarns in the backing 13. The heating, as illustrated, can be accomplished by moving the rear surface 15 of the backing 13 over a heated platen 18 which can be done on the same production line on which the intermediate structure 17 is made. Alternatively, the backing 13 could be heated to melt the binding material by using other heat sources such as heat lamps or hot air, or by placing the intermediate structure 17 in an autoclave (not shown) of the type commonly used to heat set woven structures.

As is known in the art, the pile yarn 16 can be multifilament or monofilament. When the pile yarns 16 are monofilaments they can be further processed by known methods (not shown) of heating and melting central portions of the loops so that each loop forms two projecting portions of the pile yarns that have enlarged heads at their distal ends adapted to engage with loop fastener portions. Alternatively, such monofilament loops can be heat set and cut along one side by known methods to form hooks adapted to engage with loop fastener portions.

Figure 2:
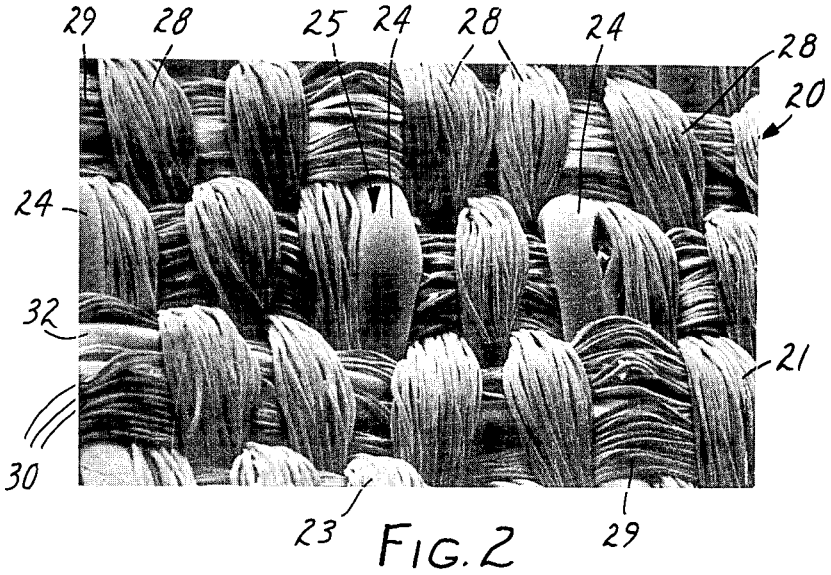
FIG. 2 is a much enlarged rear surface photographic view of an intermediate structure that can be formed during the method illustrated in FIG. 1.

When the intersecting of the yarns is done by weaving, an intermediate structure 20 of the type illustrated at about 100 times normal size in FIG. 2 can be made. Base yarns in the intermediate structure form a backing 21 having front and rear surfaces 22 and 23 in which backing 21 portions 24 of pile yarns 25 are intertwined, with other portions of the pile yarns 25 projecting from the front surface 22 to form loops 26 (not shown in FIG. 2). The base yarns comprise generally parallel multifilament warp yarns 28 and multifilament filling yarns 29 extending transverse to the warp yarns 28. As illustrated, bonding yarns are used for all of the filling yarns 29 to position a bonding yarn at each intersection with a warp yarn 28 and/or a pile yarn 25, with the filling yarns 29 each including multifilaments 30 of structural material plied with a monofilament 32 of binding material that has a significantly lower melting temperature than the softening temperature of the structural material or the material from which the warp yarns 28 or pile yarns 25 are made. Alternatively, both the warp yarns 28 and the filling yarns 29 could be bonding yarns or only all of the warp yarns 28 could be bonding yarns.

Figure 3:
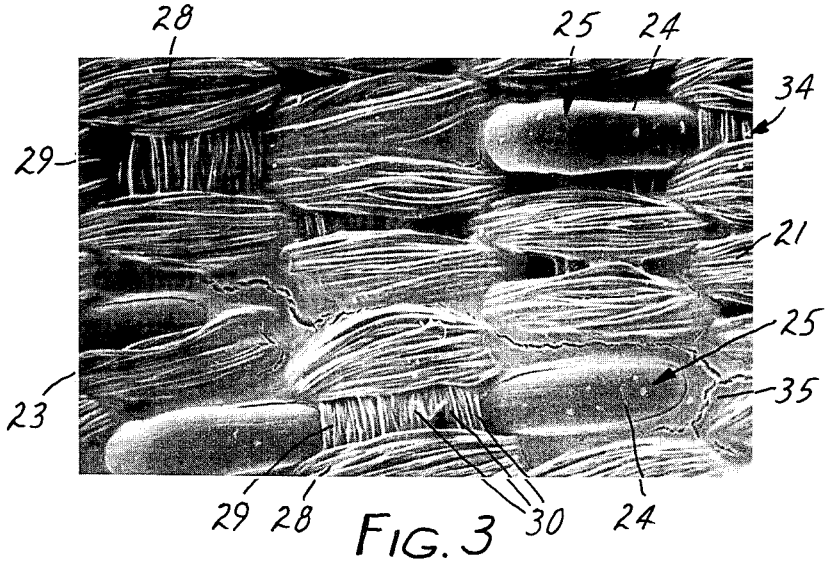
FIG. 3 is a much enlarged rear surface photographic view of a sheet material according to the present invention made from the intermediate material of FIG. 2.
Figure 4:
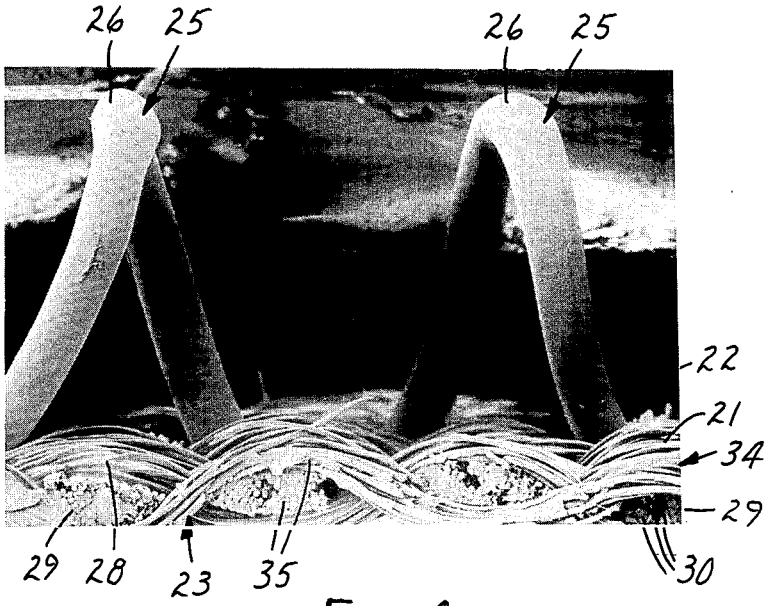
FIG. 4 is a much enlarged cross sectional photographic view of the sheet material of FIG. 3 shown against a background that forms no part of the present invention.

When the backing intermediate structure 20 is heated as by the platen 18 to a temperature above the melting temperature of the binding material but below the softening temperature of the other materials in he backing 21, the thermoplastic binding material 35 from the monofilaments 32 in the bonding yarns will melt and flow so that upon cooling it adheres both to the structural material of the multifilaments 30 in the bonding yarns and to the contacted or intersected portions of the other yarns including the entwined portions 24 of the pile yarns 25 to anchor the pile yarns 25 in the backing 21 and form a completed sheet material 34 as is shown in FIGS. 3, and 4. The binding material 35 has a non uniform distribution within the sheet material 34 in that the highest concentration of the binding material 35 is adjacent the structural material of the multifilaments 30 and its concentration becomes progressively less at portions of the warp or pile yarns 28 or 25 spaced farther away from those multifilaments 30. Thus the binding material 35 is not as uniformly distributed in the backing 21 as would be a binding material with which the backing was uniformly impregnated, however, the binding material within the sheet material 34 according to the present invention has been found to firmly anchor the pile yarns 25 and provide excellent fray resistance for fastener portions cut from the sheet material 34.

Figure 5:
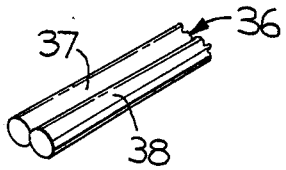
FIGS. 5, 6, 7 and 8 are enlarged fragmentary perspective views of alternate forms of bonding yarns that can be used in the intermediate structure of FIG. 2.
Figure 6:
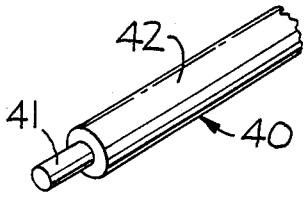
Figure 7:
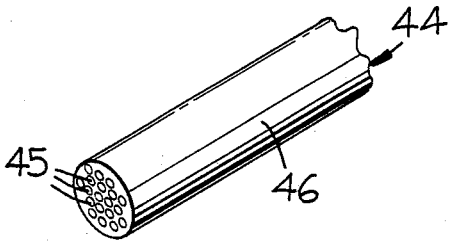
Figure 8:
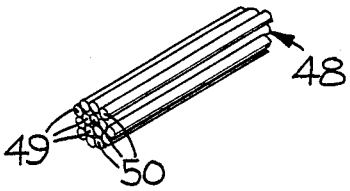

Bonding yarns useful in the present invention can have many different structures including the plied combination of multifilaments 30 and a monofilament 32 illustrated in FIG. 2, and including the several structures illustrated in FIGS. 5, 6, and 7. As illustrated in FIG. 5, such a bonding yarn 36 can consist of two side by side monofilaments 37 and 38 with the first monofilament being of the binding material and the second monofilament being of the structural material. As illustrated in FIG. 6, such a bonding yarn 40 can consist of a central monofilament 41 of the structural material an a cylindrically tubular sheath 42 of the binding material around the monofilament 41. As illustrated in FIG. 7, such a bonding yarn 44 can also consist of central multifilaments 45 of the structural material and a sheath 46 of the binding material with a cylindrically periphery around and filling the interstice between the multifilaments 45. Other structures could also be useful including a bonding yarn 48 illustrated in FIG. 8 which is a plied combination of multifilaments 49 and 50 with the multifilaments 49 being of binding material and the multifilaments 50 being of structural material and the filaments 49 and 50 of the different materials being randomly distributed in the bonding yarn 48.

Figure 9:
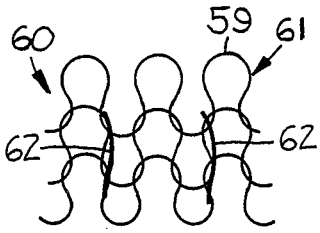
FIG. 9 is a much enlarged plan view of an alternate embodiment of a sheet material that can be formed by the method illustrated in FIG. 1.

As one alternative to weaving, the yarns may be intersected by knitting base yarns 59 to form, as illustrated in FIG. 9, an intermediate structure 60 having a backing 61 in which portions 62 of pile yarns are intertwined while other portions of the pile yarns project from a front surface (not shown) of the backing 61, in which backing 61 preferably all of the base yarns 59 are bonding yarns of the type descibed above.

Example Sheet Material No. 1: A 10 centimeter wide sheet material according to the present invention was woven on a leno type loom modified to weave over lancett (i.e., the NF model Loom made by Jakob Muller Ltd., Frick, Switzerland) using 100/34/20s multifilament nylon 6,6 warp yarns having a melting temperature of about 250 degrees Centigrade that were obtained from Omni-Fibers Inc., Scotch Plains, N.J.; 200 micron diameter monofilament polypropylene pile yarns having a melting temperature of about 168 degrees Centigrade that were obtained from Ametek Inc., Special Filaments Div., Odenton, Md.; and using bonding yarns of the type described above for filling yarn, which bonding yarns were made by plying (twisting) together at 80 turns per meter a 230 micron polyamide monofilament (that provided the binding material for the bonding yarn) that had a melting temperature of about 107 degrees Centigrade, represented about 80.8 percent by weight of the bonding yarn, and was obtained under the trade designation SF-47 from Shakespeare Monofilament Div., Columbia, S.C. with a 100/34 denier air entangled nylon multifilament (that provided the structural material for the bonding yarn) that had a melting temperature of about 250 degrees Centigrade and was obtained from Omni-Fibers Inc., Edison, N.J. The weaving was done using 413 warp yarns and 100 pile yarns to produce 1200 pics per meter along the warp yarns, and to produce loops from the pile yarns projecting about 0.18 centimeter from the front surface of the backing. The rear surface of the backing was passed at a rate of 46.5 centimeters per minute over a platen heated to 193 degrees Centigrade to melt the polyamide monofilaments so that the polyamide melted and flowed and upon cooling the polyamide material from those monofilaments adhered to the nylon filaments in the filling yarns and to the warp and pile yarns at contacted portions of those yarns. The centers of the loops were heated to form two headed stems from each loop. Hook fastener portion cut from the sheet materials had little tendency to fray along their cutedges. Hook fastener portions cut from the sheet material were engaged and disengaged 400 times with loop fastener portions cut from Style 1719 tricot knit fastener with No. 11 spray backing obtained from Gehring Tricot Corp., Dolgeville, N.Y. T-Peel, values for those engagements were measured, and were not found to decrease significantly over the 400 engagement and disengagement cycles. Also, shear and tensile test values for the loop fastener portions were similar both before and after those engagements.

Example Sheet Material No. 2: A 5 centimeter wide sheet material according to the present invention was woven on a leno type loom modified to weave over lancett (i.e., the NF model Loom made by Jakob Muller Ltd., Frick, Switzerland) using 100/34/20s multifilament nylon 6,6 warp yarns having a melting temperature of about 250 degrees Centigrade that were obtained from Omni-Fieers Inc., Scotch Plains, N.J.; 200 micron diameter nylon 6,6 monofilament pile yarns having a melting temperature of about 250 degrees Centigrade that were obtained from Shakespeare Monofilament Div., Columbia, S.C.; and using bonding yarn of the type described above for filling yarn, which bonding yarn was made by plying (twisting) together at 80 turns per meter a 70 denier (34 filament) multifilament nylon strand (that provided the structural material for the bonding yarn) that had a melting temperature of about 250 degrees Centigrade and a 150 micron diameter NX-1006 nylon monofilament (that provided the binding material for the bonding yarn) that had a melting temperature of about 135 degrees Centigrade and provided about 73 percent by weight of the bonding yarn, both obtained from Shakespeare Monofilament Div., Columbia, S.C. The weaving was done using 400 warp yarns and 64 pile yarns to produce 1500 pics per meter along the warp yarns, and to produce loops from the pile yarns projecting about 0.18 centimeter from the front surface of the backing. The sheet material was placed in an autoclave at 138 degrees Centigrade for 20 minutes which melted the nylon monofilaments so that the nylon material from those monofilaments flowed onto and upon cooling adhered to the nylon filaments in the filling yarns and to the warp and pile yarns at the junctures with those yarns. The loops were then cut along one side to form hooks. Hook fastener portions cut from the sheet material had little tendency to fray along their cut edges. Such hook fastener portions were engaged and disengaged with loop fastener portions cut from the loop fastener portion sold under the trade designation Scotchmate SJ-3401 Loop from Minnesota Mining and Manufacturing Company, St. Paul, Minn., and were found to engage and disengage satisfactorily without pulling the hooks from the backing.

Example Sheet Material No. 3: A 5 centimeter wide sheet material according to the present invention was woven on a leno type loom modified to weave over lancett (i.e., the NF model Loom made by Jakob Muller Ltd., Frick, Switzerland) using 100/34/20s multifilament nylon 6,6 warp yarns having a melting temperature of about 250 degrees Centigrade that were obtained from Omni-Fibers Inc., Scotch Plains, N.J.; 200/10/5s nylon 6,6 multifilament pile yarns having a melting temperature of about 250 degrees centigrade that were obtained from E. I. DuPont Nemours Co. Inc., Textile Fiber Dept., Wilmington, Del., and using bonding yarn of the type described above for filling yarn, which bonding yarn wa made by plying (twisting) together at 80 turns per meter a 70 denier (34 filament) multifilament nylon 6,6 strand having 60 twists per meter (that provided the structural material for the bonding yarn) that had a melting temperature of about 250 degrees Centigrade and was obtained from E. I. DuPont Nemours Co. Inc., Textile Fiber Dept., Wilmington, Del., and a 150 micron diameter nylon monofilament (that provided the binding material for the bonding yarn) that had a melting temperature of about 135 degrees Centigrade, represented 73 percent by weight of the bonding yarn, and was obtained under the trade designation NX-1006 from Shakespeare Monofilament Division, Columbia, S.C. The weaving was done using 316 warp yarns and 62 pile yarns to produce 1500 pics per meter along the warp yarns, and to produce loops from the pile yarns projecting about 0.23 centimeter from the front surface of the backing. The sheet material was placed in an autoclave at 138 degrees Centigrade for 20 minutes which melted the NX-1006 nylon monofilaments so that the nylon material from those monofilaments flowed and upon cooling adhered to the nylon 6,6 filaments in the filling yarns and to the warp and pile yarns at the junctures with those yarns. Loop fastener portions cut from the sheet material had little tendency to fray, and could be dyed various colors (e.g., black white, beige and silver) with no streaking. Also, the loops in the fastener portions were found to be firmly anchored over a large number of engagement and disengagement cycles with hook fastener portions.

Example Sheet Material No. 4: A 2.5 centimeter wide sheet material according to the present invention was woven on a leno type loom modified to weave over lancett (i.e., the NF model Loom made by Jakob Muller Ltd., Frick, Switzerland) using 150/34/5s multifilament polyester warp yarns having a melting temperature of about 250 degrees Centigrade that were obtained from C. M. Patterson Yarns, Evanston, Ill.; 200 micron diameter polypropylene monofilament pile yarns having a melting temperature of about 168 degrees Centigrade that were obtained from Ametek Inc., Special Filaments Division, Odenton, Md.; and using bonding yarn of the type described above for filling yarn, which bonding yarn was made by plying (twisting) together at 80 turns per meter a 150 denier (34 filament) multifilament polyester strand having 60 twists per meter (that provided the structural material for the bonding yarn) that had a melting temperature of about 250 degrees Centigrade and was obtained from Shakespeare Monofilament Division, Columbia, S.C., and a 150 micron diameter polyester monofilament (that provided the binding material for the bonding yarn) that had a melting temperature of about 128 degrees Centigrade, represented about 60.1 percent by weight of the bonding yarn, and was obtained under the product number PX-1006 from Burlington Industries, Bulington Madison Yarn Div., Greensboro, N.C. The weaving was done using 136 warp yarns and 24 pile yarns to produce 1260 pics per meter along the warp yarns, and to produce loops from the pile yarns projecting about 0.18 centimeter from the front surface of the backing. The back surface of the backing was passed over a heated platen at 177 degrees Centigrade at a speed of 0.33 meters per minute which melted the polyester monofilaments so that the polyester material from those monofilaments flowed and upon cooling adhered t the polyester filaments in the filling yarns and to the warp and pile yarns at the junctures with those yarns. The centers of the loops were heated to form two headed stems from each loop. Hook fastener portions cut from the sheet material had little tendency to fray along their cut edges. Such hook fastener portions were engaged and disengaged numerous times with loop fastener portions, and were found to engage and disengage satisfactorily without pulling the headed stems from the backing.

Example Sheet Material No. 5: A 2.5 centimeter wide sheet material according to the present invention was woven on a leno type loom modified to weave over lancett (i.e., the NF model Loom made by Jakob Muller Ltd., Frick, Switzerland) using 150/34/5s multifilament polyester warp yarns having a melting temperature of about 250 degrees Centigrade that were obtained from C. M. Patterson Yarns, Evanston, Ill.; 200 micron diameter polypropylene monofilament pile yarns having a melting temperature of about 168 degrees Centigrade that were obtained from Ametek Inc., Special Filaments Division, Odenton, Md.; and using bonding yarn of the type described above for filling yarn, which bonding yarn was a 150 denier polyester multifilament (that provided the structural material for the bonding yarn) that had a melting temperature of about 250 degrees Centigrade and was sheathed and filled around its filaments with an ethylene vinyl acetate copolymer resin (that provided the binding material for the bonding yarn) that had a melting temperature of about 100 degrees Centigrade, represented about 60 percent by weight of the bonding yarn, and was obtained under the trade name "Raufil Filaments" from Rehau Plastics Inc., Leesburg, Va. The weaving was done using 136 warp yarns and 24 pile yarns to produce 1260 pics per meter along the warp yarns, and to produce loops from the pile yarns projecting about 0.18 centimeter from the front surface of the backing. The back surface of the backing was passed over a heated platen at 163 degrees Centigrade at a speed of 0.41 meters per minute which melted the ethylene vinyl acetate copolymer resin so that it flowed and upon cooling adhered both to the polyester filaments in the filling yarns and to the warp and pile yarns at the junctures with those yarns. The centers of the loops were heated to form two headed stems from each loop. Hook fastener portions cut from the sheet material had little tendency to fray along their cut edges. Such hook fastened portions were engaged and disengaged numerous times with loop fastener portions, and were found to engage and disengage satisfactorily without pulling the headed stems from the backing.

COMPARATIVE EXAMPLES

A comparison (the results of which are reported in Table I) was made between the anchoring of loops in loop fastener portions with differing pic counts from (1) a first group of sheet materials according to the present invention (i.e., Example Sheet Materials 6 through 15) in which the loops were anchored by utilizing a bonding yarn of the type described above as a fill yarn in its woven backing, (2) a second group of sheet materials (i.e., Example Sheet Materials 16 through 26) similar to the first group of sheet materials except that no bonding yarns of the type described above were used and the loops were anchored by impregnating the backing with a conventional binder coating, and (3) a third group of sheet materials (i.e., Example Sheet Materials 27 through 37) similar to the first group of sheet materials except that no bonding yarns of the type described above were used and no other anchoring was provided for the loops except for the mechanical engagement provided by the weaving process.

Example Sheet Materials 6 through 15: For each of the first group of Example sheet Materials, 6 through 15, a 2.5 centimeter wide sheet material according to the present invention was woven on a leno type loom modified to weave over lancett (i.e., the NF model Loom made by Jakob Muller Ltd., Frick, Switzerland) using 150/34/5s multifilament polyester warp yarns having a melting temperature of about 250 degrees Centigrade that were obtained from C. M. Patterson Yarns, Evanston, Ill.; 200 micron diameter polypropylene monofilament pile yarns having a melting temperature of about 168 degrees Centigrade that were obtained from Ametek Inc., Special Filaments Division, Odenton, Md. and using bonding yarn of the type described above for the filling yarn, which bonding yarn consisted of a 150 denier (34 filament) multifilament polyester strand having 60 twists per meter (that provided the structural material for the bonding yarn) that had a melting temperature of about 250 degrees Centigrade and was obtained from Burlington Industries, Burlington Madison Yarn Div., Greensboro, N.C., and a 150 micron diameter polyamide monofilament (that provided the binding material for the bonding yarn) that had a melting temperature of about 107 degrees Centigrade and was obtained as product number SSF-47 from Shakespeare Monofilament Division, Columbia, S.C. The weaving was done using 136 warp yarns and 24 pile yarns to produce the number of pics per meter along tee warp yarns shown in Table I, and to produce loops from the pile yarns projecting about 0.18 centimeter from the front surface of the backing. The sheet materials were placed in an autoclave at 138 degrees Centigrade for 20 minutes which melted the polyamide monofilaments so that the polyamide material from those monofilaments flowed and upon cooling adhered to the polyester filaments in the filling yarns and to the warp and pile yarns at the junctures with those yarns. Loop fastener portions cut from the sheet materials had little tendency to fray.

The force required to pull single loops out of these sheet materials was measured using an Instron tensile tester by positioning a test length at least 2.5 centimeter long of each sheet material across a test fixture with the rear surface of its backing against a planar support surface on the test fixture and its loops projecting from the front surface of its backing away from the support surface. The test length of sheet material was clamped to the test fixture adjacent its ends, and parallel wires spaced about 1 centimeter apart were tensioned across the front surface of the test length of sheet material to restrain the movement of the test length of sheet material away from the support surface of the test fixture in a direction normal to its front surface, while not restricting relative motion between yarns in the test length between its clamped ends. The test fixture holding the test length of sheet material was clamped to the lower jaw of the Instron with the support surface horizontal and the loops projecting upwardly. A small size number 10 "Eagle Claw" brand fish hook sold by Wright and McGill Co., Denver, Colo., was tied to a 15 centimeter long nylon monofilament fishing line, and the end of the fishing line opposite the hook was clamped in the center of the upper jaw of the Instron testing machine which was attached to a load cell mounted in a vertically movable crosshead so that hook hung below that upper jaw. The gauge length of the Instron testing machine was adjusted to about 10 centimeters, and the full scale load cell deflection was set to equal 44.5 Newtons. A test row of loops (i.e., a row of loops aligned in the direction of the filling yarns and wires) was selected at random on the test length of sheet material, and all of the loops in the similar rows on each side of the test row were severed so that they would not restrict pull out of the loops in the test row. The fish hook was inserted through a loop in the test row which was selected at random, the cross head was moved upwardly away from the lower jaw at a speed of 5 centimeters per minute until the loop engaged by the fish hook was pulled from the backing of the test length of sheet material, and the maximum force required to pull the loop from the backing of the test length of sheet material was measured by the load cell. Ten loops from different portions of the test length of sheet material were thus pulled from the backing, the maximum force required was averaged, and that average force is recorded in Table I together with the standard deviation of the ten force values measured.

Example Sheet Materials 16 through 26: Each of the second group of Example sheet Materials, 16 through 26, was woven on the same leno type loom using the same yarns and methods described above for Example Sheet Materials 6 through 15 except that the filling yarns included only the 150 denier (34 filament) multifilament polyester strand having 60 twists per meter, and did not include the 150 micron diameter polyamide monofilament. Subsequent to autoclaving, the backings of these Example Sheet Materials were impregnated with 71 grams per square meter of the urethane binder used in the loop fastener portion sold under the trade designation Scotchmate SJ-3401 Loop from Minnesota Mining and Manufacturing Company, St. Paul, Minn. The forces required to pull loops from the second group of Example Sheet Materials, 16 through 26 were tested in the manner described above for the Example Sheet Materials 6 through 15, and the results are recorded in Table I. The loop pull out values for the Example Sheet Materials 16 through 26 were about the same, though slightly lower than the loop pull out values for the Example Sheet Materials 6 through 15.

Example Sheet Materials 27 through 37: Each of the third group of Example sheet Materials, 27 through 37 was woven on the same leno type loom using the same yarns and methods described above for Example Sheet Materials 6 through 15 except that the filling yarns included only the 150 denier (34 filament) multifilament polyester strand having 60 twists per meter, and did not include the 150 micron diameter polyamide monofilament. The Example Sheet Materials 27 through 37 were autoclaved as described for Example Sheet Materials 6 through 15, and no binding coating was applied to their backings. The forces required to pull loops from the third group of Example Sheet Materials 27 through 37 were tested in the manner described above for the Example Sheet Materials 6 through 15, and the results are recorded in Table I. The loop pull out values for the Example Sheet Materials 27 through 37 were significantly lower than the loop pull out values for the Example Sheet Materials 6 through 15 or the Example Sheet Materials 16 through 26.

TABLE I

| | Pics Per Meter | | Hook Pullout Force (Newtons) | |
|---|---|---|---|---|
| Example # | Before Autocl. | After Autocl. | Average | Std. Dev. |
| 6 | 1025 | 1065 | 2.76 | 0.44 |
| 7 | 1100 | 1180 | 2.67 | 0.31 |
| 8 | 1220 | 1220 | 3.83 | 0.44 |
| 9 | 1300 | 1300 | 3.96 | 0.40 |
| 10 | 1260 | 1300 | 3.07 | 0.27 |
| 11 | 1380 | 1380 | 4.32 | 0.40 |
| 12 | 1455 | 1495 | 4.45 | 0.53 |
| 13 | 1495 | 1495 | 5.25 | 0.89 |
| 14 | 1575 | 1615 | 6.50 | 1.02 |
| 15 | 1655 | 1695 | 6.36 | 0.89 |
| 16 | 1025 | 1065 | 1.82 | 0.44 |
| 17 | 1100 | 1180 | 2.58 | 0.53 |
| 18 | 1220 | 1220 | 2.22 | 0.49 |
| 19 | 1260 | 1300 | 3.07 | 0.58 |
| 20 | 1300 | 1300 | 3.69 | 0.85 |
| 21 | 1380 | 1380 | 2.94 | 0.44 |
| 22 | 1455 | 1495 | 3.92 | 0.53 |
| 23 | 1695 | 1695 | 4.76 | 0.71 |
| 24 | 1730 | 1730 | 4.54 | 0.76 |
| 25 | 1810 | 1810 | 4.94 | 0.53 |
| 26 | 1890 | 1890 | 5.34 | 0.58 |
| 27 | 1025 | 1065 | 1.25 | 0.18 |
| 28 | 1100 | 1180 | 1.25 | 0.13 |
| 29 | 1180 | 1180 | 1.38 | 0.18 |
| 30 | 1220 | 1220 | 1.33 | 0.22 |
| 31 | 1300 | 1300 | 1.33 | 0.18 |
| 32 | 1380 | 1380 | 1.20 | 0.36 |
| 33 | 1455 | 1495 | 1.69 | 0.31 |
| 34 | 1535 | 1535 | 2.27 | 0.40 |
| 35 | 1695 | 1695 | 2.71 | 0.49 |
| 36 | 1730 | 1730 | 3.16 | 0.62 |
| 37 | 1810 | 1810 | 3.83 | 0.62 |

The present invention has now been described with reference to several embodiments thereof. It will be apparent to those skilled in the art that many changes can be made in the embodiments described without departing from the scope of the present invention. Thus the scope of the present invention should not be limited to the structures descried in this application, but only by structures described by the language of the claims and the equivalents of those structures.

We claim:

1. An intermediate structure which may be heated to make a sheet material adapted to be cut into smaller ravel resistant pieces to form portions of a fastener, said intermediate structure comprising:

base yarns of polymeric material having intersecting portions forming a backing having front and rear major surfaces, at least some of the base yarns being bonding yarns comprising a first portion formed of a polymeric structural material and a second portion formed of a thermoplastic binding material having a significantly lower melting temperature than the softening temperature of the structural material; and pile yarns of polymeric material having portions entwined into the backing and other portions projecting from the front surface of the backing with each of the entwined portions of the pile yarns contacting at least on of the bonding yarns.

2. An intermediate structure according to claim 1 wherein said backing is woven and said base yarns comprise generally parallel warp yarns and filling yarns extending transverse to the warp yarns, with said bonding yarns providing all of the filling yarns.

3. An intermediate structure according to claim 1 wherein said backing is woven and said base yarns comprise generally parallel warp yarns and filling yarns extending transverse to the warp yarns, with said bonding yarns providing all of the warp yarns.

4. An intermediate structure according to claim 1 wherein said backing is knitted with said bonding yarns providing all of the base yarns.

5. An intermediate structure according to claim 1 wherein the melting temperature of the binding material is generally in the range of 70 to 205 degrees Centigrade and at least 20 Centigrade degrees lower than the softening temperature of said structural material and said pile yarns.

6. An intermediate structure according to claim 1 wherein said bonding yarns each comprise a multifilament of said structural material and a monofilament of said binding material plied together.

7. An intermediate structure according to claim 1 wherein said bonding yarns each comprise a monofilament of said structural material and a cylindrically tubular sheath around said monofilament of said binding material.

8. An intermediate structure according to claim 1 wherein said bonding yarns each comprise a multifilament of said structural material and a sheath of said binding material around and filling the interstices of said multifilament.

9. An intermediate structure according to claim 1 wherein said bonding yarns each comprise a monofilament of said structural material and a monofilament of said binding material laid side by side.

10. An intermediate structure according to claim 1 wherein said bonding yarns each comprise a plied multifilament with some of said filaments being of said structural material and some of said filaments being of said binding material.

11. An intermediate structure according to claim 1 wherein said bonding yarns each comprise a plied multifilament with some of said filaments being of said structural material and some of said filaments being of said binding material and said filaments of said different materials being randomly disposed in said yarn.

12. A sheet material adapted to be cut into smaller ravel resistant pieces to form portions of a fastener, said sheet material comprising:

polymeric base yarns having intersecting portions forming a backing having front and rear major surfaces, at least some of the base yarns being bonding yarns comprising a first portion formed of a polymeric structural material and a second portion formed of a thermoplastic binding material having a significantly lower melting temperature than the softening temperature of the structural material; and pile yarns of polymeric material having portions entwined in the backing and other portions projecting from the front surface of the backing, the entwined portions of the pile yarns each contacting at least one of the bonding yarns with the binding material adhered to the structural material along the bonding yarns and to portions of the yarns that contact the bonding yarns to bond the backing together and anchor the pile yarns in the backing, the binding material having a non uniform distribution within the sheet material with the highest concentration of the binding material being adjacent the structural material and its concentration becomes progressively less at portions of the warp yarns and pile yarns spaced farther away from the structural material.

13. A sheet material according to claim 12 wherein said backing is woven and said base yarns comprise generally parallel warp yarns and filling yarns extending transverse to the warp yarns, with all of the filling yarns being said bonding yarns with the binding material adhered to the structural material along the bonding yarns and to portions of the warp yarns and pile yarns that contact the bonding yarns.

14. A sheet material according to claim 12 wherein said backing is woven and said base yarns comprise generally parallel warp yarns and filling yarns extending transverse to the warp yarns, with all of the warp yarns being said bonding yarns with the binding material adhered to the structural material along the bonding yarns and to the portions of the filling yarns and pile yarns that contact the bonding yarns.

15. A sheet material according to claim 12 wherein said backing is knitted with all of the base yarns being said bonding yarns with the binding material adhered to the structural material along the bonding yarns and to the portions of the bonding yarns and pile yarns that contact the bonding yarns.

16. A sheet material according to claim 12 wherein said portions of said pile yarns projecting from said front surface form loops.

17. A sheet material according to claim 12 wherein said pile yarns are monofilaments, and said portions of said pile yarns projecting from said front surface have enlarged heads at their distal ends.

18. A sheet material according to claim 12 wherein said pile yarns are monofilaments, and said portions of said pile yarns projecting from said front surface are hooks formed by cutting loops along one side.

19. A sheet material according to claim 12 wherein the melting temperature of the binding material is generally in the range of 70 to 205 degrees Centigrade and at least 20 Centigrade degrees lower than the softening temperature of said structural material and said pile yarns.

20. A method for making a sheet material adapted to be cut into smaller ravel resistant pieces to form portions of a fastener, which method comprises the steps of:

intersecting portions of polymeric base yarns to form a backing having front and rear major surfaces, at least some of the base yarns being bonding yarns comprising a first portion formed of a polymeric structural material and a second portion formed of a thermoplastic binding material having a significantly lower melting temperature than the softening temperature of the structural material;

entwining portions of polymeric pile yarns into the backing while causing portions of the pile yarns to project from the front surface of the backing, with each entwined portion of the pile yarns contacting at least one of the bonding yarns; and heating the backing to melt the binding material so that the binding material will flow and upon cooling will adhere to adjacent portions of the yarns.

21. A method for making a sheet material according to claim 20 wherein said step of intersecting comprises weaving the backing using base yarns comprising generally parallel warp yarns and filling yarns extending transverse to the warp yarns, with all of the filling yarns being said bonding yarns.

22. A method for making a sheet material according to claim 20 wherein said step of intersecting comprises weaving the backing using base yarns comprising generally parallel warp yarns and filling yarns extending transverse to the warp yarns, with all of the warp yarns being said bonding yarns.

23. A method for making a sheet material according to claim 20 wherein said step of intersecting comprises knitting the backing using generally parallel base yarns, with all of the base yarns being said bonding yarns.

24. A method for making a sheet material according to claim 20 wherein the melting temperature of the binding material is in the range of about 70 to 205 degrees Centigrade, and said step of heating comprises the step of passing the rear surface of the backing along a platen heated to a temperature in that range on the same production line on which said intersecting and entwining steps are performed.

25. A method for making a sheet material according to claim 20 wherein the melting temperature of the binding material is in the range of about 70 to 205 degrees Centigrade and at least 20 Centigrade degrees lower than the softening temperature of the structural material and the pile yarns, and said step of heating is performed in an autoclave which heat sets the backing at a temperature in that range.

* * * * *